US008735699B2

(12) United States Patent
Burgett et al.

(10) Patent No.: US 8,735,699 B2
(45) Date of Patent: May 27, 2014

(54) MAIN ACTION RAIL FOR UPRIGHT PIANO WITH FRONT-ACCESSIBLE WHIPPEN FLANGE SCREW

(76) Inventors: Kirk Burgett, Sacramento, CA (US); Jamie Marks, Haverhill, MA (US); Dana Mazzaglia, Haverhill, MA (US)

( * ) Notice: Subject to any disclaimer, the term of this patent is extended or adjusted under 35 U.S.C. 154(b) by 177 days.

(21) Appl. No.: 13/354,251

(22) Filed: Jan. 19, 2012

(65) Prior Publication Data

US 2013/0186251 A1 Jul. 25, 2013

(51) Int. Cl.
*G10C 3/18* (2006.01)
*G10C 5/00* (2006.01)

(52) U.S. Cl.
USPC ..... 84/242; 84/236; 84/240; 84/251

(58) Field of Classification Search
USPC ..... 84/236, 240–242, 247–253
See application file for complete search history.

(56) References Cited

U.S. PATENT DOCUMENTS

| | | | | | |
|---|---|---|---|---|---|
| 345,706 | A * | 7/1886 | Letton | 84/241 |
| 486,808 | A * | 11/1892 | Guild | 84/241 |
| 515,152 | A * | 2/1894 | Ludwig et al. | 84/240 |
| 651,799 | A * | 6/1900 | Guild | 84/241 |
| 810,920 | A * | 1/1906 | Darley, Jr. | 84/240 |
| 813,263 | A * | 2/1906 | Werner | 84/253 |
| 851,001 | A * | 4/1907 | Doyle | 84/240 |
| 1,125,304 | A * | 1/1915 | Gilmore | 84/240 |
| 2,116,117 | A * | 5/1938 | Homm | 84/240 |
| 2,226,877 | A * | 12/1940 | Schulze | 84/240 |
| 2,230,698 | A * | 2/1941 | Schulze | 84/240 |
| 2,260,335 | A * | 10/1941 | Potvvin | 84/240 |
| 2,277,077 | A * | 3/1942 | Dasenbrook | 84/240 |
| 2,329,009 | A * | 9/1943 | Socin | 84/240 |
| 2,424,017 | A * | 7/1947 | Brown | 84/240 |
| 2,424,018 | A * | 7/1947 | Brown | 84/240 |
| 2,425,989 | A * | 8/1947 | Brown | 84/240 |
| 2,436,875 | A * | 3/1948 | Socin | 84/240 |
| 2,445,512 | A * | 7/1948 | Brown | 84/240 |
| 2,470,654 | A * | 5/1949 | Schultz | 84/240 |
| 2,917,962 | A * | 12/1959 | Ballet | 84/242 |
| 4,756,223 | A * | 7/1988 | Murakami | 84/21 |
| 4,840,101 | A * | 6/1989 | Kummer | 84/247 |
| 4,879,939 | A * | 11/1989 | Wall | 84/240 |
| 5,123,321 | A * | 6/1992 | Caught | 84/242 |
| 5,353,671 | A * | 10/1994 | Inoue et al. | 84/236 |
| 5,679,914 | A * | 10/1997 | Niitsuma | 84/687 |
| 5,949,013 | A * | 9/1999 | Satoshi | 84/719 |
| 7,408,102 | B2 * | 8/2008 | Kugimoto | 84/402 |
| 7,858,858 | B2 * | 12/2010 | Eitaki et al. | 84/240 |
| 8,294,009 | B2 * | 10/2012 | Muramatsu et al. | 84/240 |
| 8,389,833 | B2 * | 3/2013 | Muramatsu et al. | 84/240 |
| 8,487,172 | B1 * | 7/2013 | Burgett et al. | 84/451 |
| 8,541,671 | B1 * | 9/2013 | Burgett et al. | 84/222 |
| 8,614,382 | B2 * | 12/2013 | Burgett et al. | 84/218 |

(Continued)

*Primary Examiner* — David S. Warren
(74) *Attorney, Agent, or Firm* — Craig A. Simmermon

(57) ABSTRACT

An upright piano main action rail with a special cross sectional shape of its lower half that angles or curves towards the back of the piano to effectively relocate the lower front surface of upright piano main action rail from a position in front of the row of whippen flanges as with the prior art to a relocated new position behind the row of whippen flanges to enable the front mounting of whippen flanges to the main action rail. Upright piano main action rail has all whippen mounting holes located its the lower front surface instead of the lower rear surface as with prior art upright piano main action rails.

1 Claim, 5 Drawing Sheets

(56) References Cited

U.S. PATENT DOCUMENTS

2013/0186250 A1* 7/2013 Burgett et al. ..... 84/242
2013/0186251 A1* 7/2013 Burgett et al. ..... 84/242
2013/0186252 A1* 7/2013 Burgett et al. ..... 84/254
2013/0247740 A1* 9/2013 Burgett et al. ..... 84/218
2013/0247741 A1* 9/2013 Burgett et al. ..... 84/240

* cited by examiner

MAIN ACTION RAIL FOR UPRIGHT PIANO WITH FRONT-ACCESSIBLE WHIPPEN FLANGE SCREW

BACKGROUND OF THE INVENTION

1. Field of the Invention

This invention relates to upright piano actions, or more specifically the mechanisms in upright pianos that transmit motion from a piano player's fingers into motion of a hammer, located inside the piano, causing the hammer to strike a piano string, thereby producing sound or music from the piano. In every piano, there is a separate piano action and hammer corresponding to each piano key, where there are typically 88 keys in a piano. All piano actions and the hammers must be fastened to a stationary "rail" inside the piano in order to allow for proper motion of the piano action's subcomponents and cycling of the piano action. There is more than one rail in an upright piano, including the damper spring rail, the hammer rail, the main action rail, the let-off rail, the sticker rail, capstan rail, the balance rail, and the front rail. Typically, all rails run horizontally across the width of the piano, parallel to the row of piano keys on the piano. This invention deals with the "main action rail" of an upright piano.

2. Description of Related Art

Prior art main action rails for upright pianos include a design with whippen flange screw holes located on the rear or back of the piano action, where rear or back is defined as the side opposite the piano keys. With prior art main actions rails, the whippen flange screws are only accessible from the rear of the piano.

This poses a huge problem for piano technicians for logistical reasons because a great deal of work is required to gain access to the whippen flange screw located at the rear of the piano action. Periodically, for proper maintenance of the piano, replacement or repair of piano action subcomponents is required, thereby requiring the removal of whippens and whippen flanges from the piano.

To remedy this, the main action rail for upright piano of this invention includes a design with the whippen mounting holes located on the front of the main action rail, thereby providing front-access to all whippen flange screws, thereby greatly reducing the work required for technicians to remove the whippen assembly.

BRIEF SUMMARY OF THE INVENTION

It is an aspect of this invention to provide a main action rail for an upright piano with front-mountable whippen flanges.

It is an aspect of this invention to provide a main action rail for an upright piano with a "lower-front surface" that is located behind the "lower-rear surface" of prior art main action rails for upright pianos.

It is an aspect of this invention to provide a main action rail for an upright piano with a thinner cross-sectional design as compared to that in the prior art.

It is an aspect of this invention to provide a main action rail for an upright piano where the tapped holes for mounting the whippen flanges are located on the "front" surface of the main action rail and not on the "rear" surface of the main action rail.

It is an aspect of this invention to provide a main action rail for an upright piano with design that provides the ability to install all whippen flanges from the front of the piano action where the hinge pin or center pin in each whippen flange remains in the exact same location as those hinge or center pins in whippen flanges attached to prior art main action rails.

DEFINITION LIST

| Term | Definition |
|---|---|
| 1 | Prior Art Main Action Rail |
| 2 | Damper Lever |
| 3 | Whippen Flange Screw |
| 4 | Damper Spoon |
| 5 | Whippen Flange |
| 6 | Center Pin or Hinge Pin |
| 7 | Whippen |
| 8 | Back or Rear of Piano Action |
| 9 | Main Action Rail with Front-Accessible Whippen Flange Screw |
| 10 | Damper Lever |
| 11 | Whippen Flange Screw |
| 12 | Damper Spoon |
| 13 | Whippen Flange |
| 14 | Center Pin or Hinge Pin |
| 15 | Whippen |
| 16 | Front of Piano Action |

DETAILED DESCRIPTION OF THE INVENTION

Figure 1:
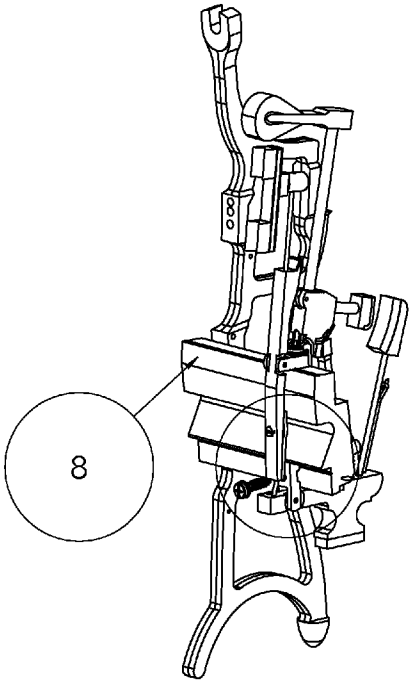
Prior Art Fig. 1
FIG. 1 is a right rear perspective view of a prior art main action rail depicting a whippen flange screw just prior to insertion of the whippen flange screw into a whippen flange mounting hole located on the rear of the main action rail and blow-up thereof.
Figure 1:
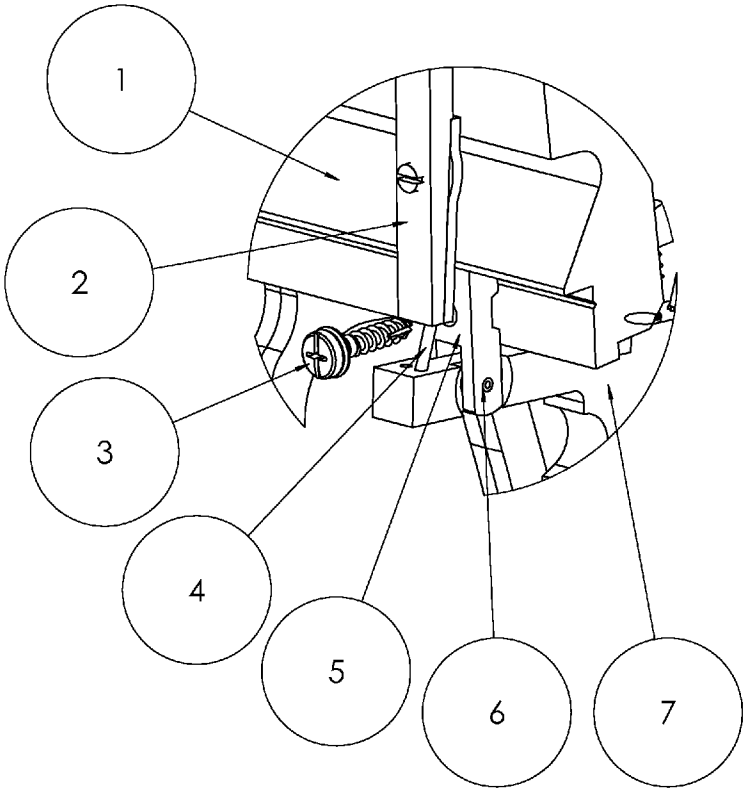
Prior Art Fig. 1
Figure 2:
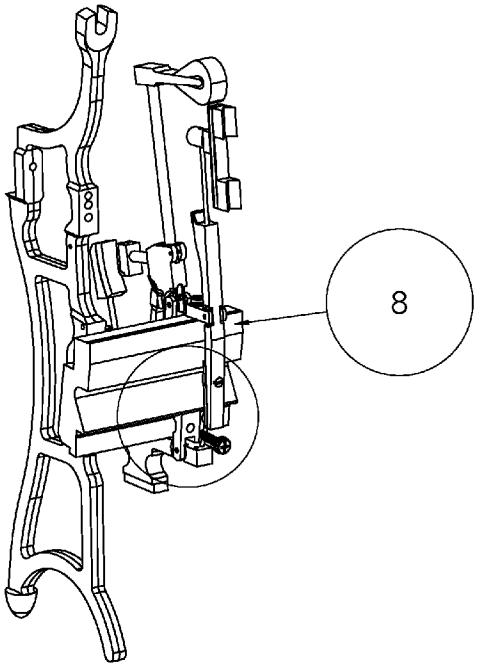
Prior Art Fig. 2
FIG. 2 is a left rear perspective view of a prior art main action rail depicting a whippen flange screw just prior to insertion of the whippen flange screw into a whippen flange mounting hole located on the rear of the main action rail and blow-up thereof.
Figure 2:
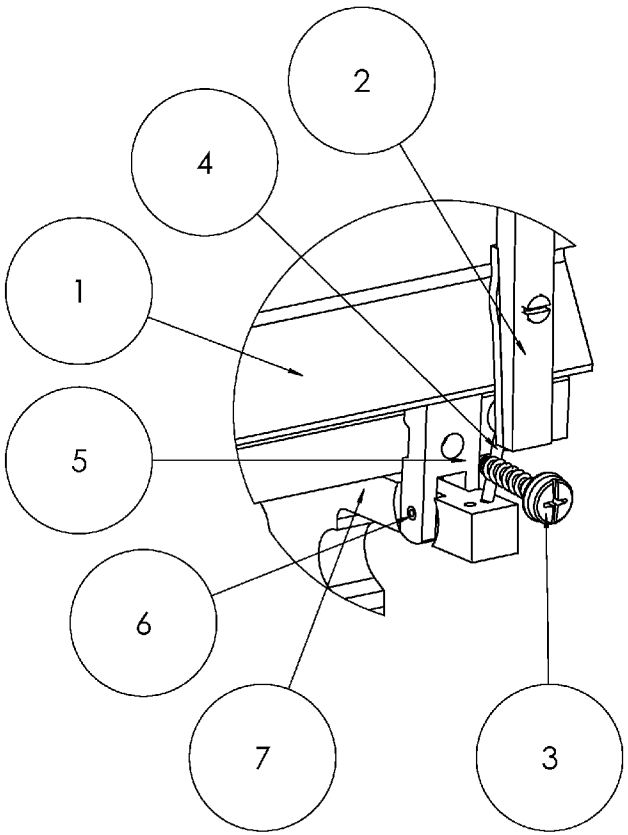
Prior Art Fig. 2

FIGS. 1 and 2 depict a prior art main action rail 1 for an upright piano. A main action rail is a stationary rail running horizontally across the entire width of the piano keys of the upright piano. All 88 whippens 7 and 88 whippen flanges 5 must be affixed or adhered to the main action rail 1. FIGS. 1 and 2 depict cut-away views of the main action rail 1, showing just one of the 88 piano actions and whippen assemblies of the piano. Depictions of main action rails 1 in FIGS. 1 and 2 are cut-away views of the full width of the main action rail 1.

Prior art main action rails 1 for upright pianos include a design where the tapped holes or mounting holes for the whippen flange are located on the rear or back 8 of the main action rail 1.

This poses a huge problem for piano technicians for logistical reasons because a great deal of work is required to gain access to the whippen flange screw 3 located at the rear of the piano action 8. Periodically, for proper maintenance of the piano, replacement or repair of piano action subcomponents is required, thereby requiring the removal of whippens 7 and whippen flanges 5 from the piano.

To remedy this, main action rail for upright pianos with front-accessible whippen flange screws 9 includes a design with location of the whippen mounting holes on the front of the main action rail 9, thereby providing front-access to all whippen flange screws 11, thereby greatly reducing the work required for technicians to remove the whippen flange 13 and whippen 15.

This is accomplished by the re-design of the cross-section of main action rail for upright pianos with front-accessible whippen flange screws 9. As can be seen from a comparison between FIGS. 1 and 3, we see that, in FIG. 3, with the new rail 9, the front surface of the new rail 9, into which whippen flange screw 11 is installed, has been "set-back" or moved backwards, as compared to the corresponding front surface of prior art rail 1 in FIG. 1. (Note that FIG. 1 depicts a back-view of the action, while FIG. 3 depicts a front-view of the action, so we must compare the surface depicted in FIG. 3 to the surface not depicted in FIG. 1.)

Figure 3:
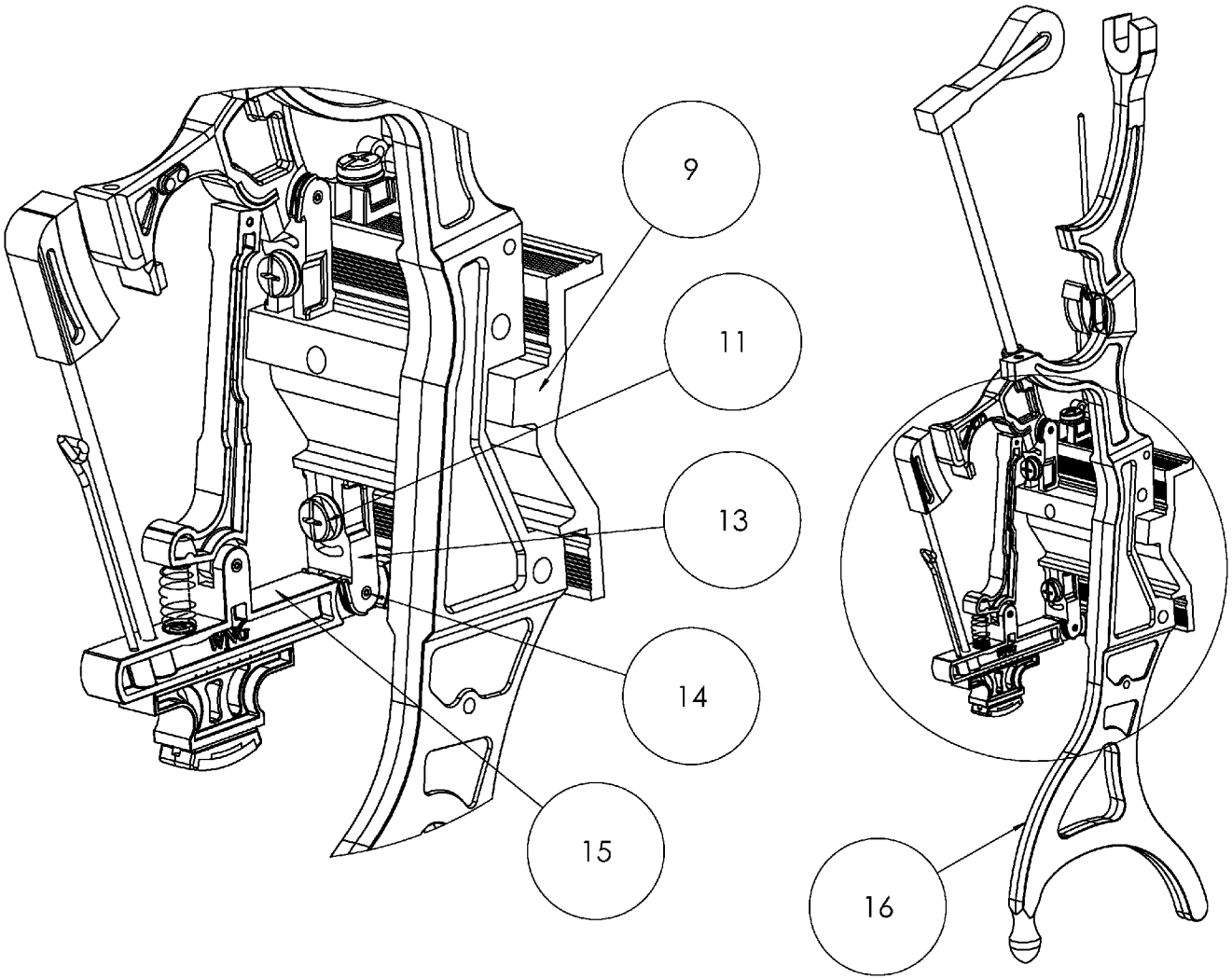
FIG. 3 is a right front perspective view of main action rail for upright piano with front-accessible whippen flange screws depicting a whippen flange screw after installation of the whippen flange screw into a whippen flange mounting hole located on the front of the main action rail and blow-up thereof.
Figure 4:
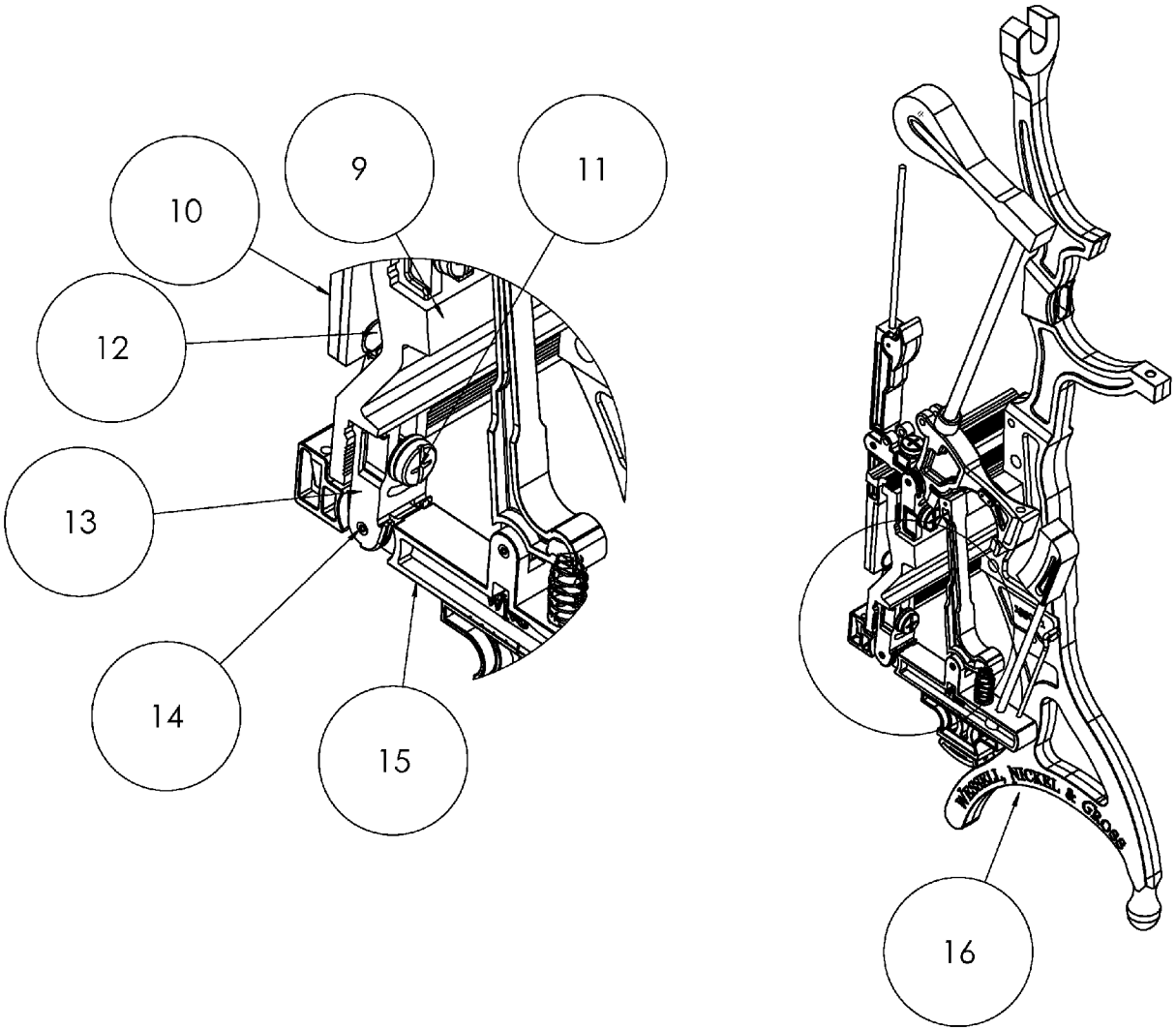
FIG. 4 is a left front perspective view of main action rail for upright piano with front-accessible whippen flange screws depicting a whippen flange screw after installation of the whippen flange screw into a whippen flange mounting hole located on the front of the main action rail and blow-up thereof.

The location of each whippen flange 5 and 13 in each of FIGS. 1 and 3 remains constant, so that, in relation to the other action components, whippen flange 5 has the exact same location as whippen 13. More precisely, hinge pin 6 has the exact same location as hinge pin 14. The only difference in the flanges is that whippen flange 5 uses a whippen flange screw 3 entering from the rear 8, while whippen flange 13 uses a whippen flange screw 11 entering from the front 16. This aspect provides the ability for main action rail for upright pianos with front-accessible whippen flange screws 9 to be compatible with prior art piano action components.

Figure 5:
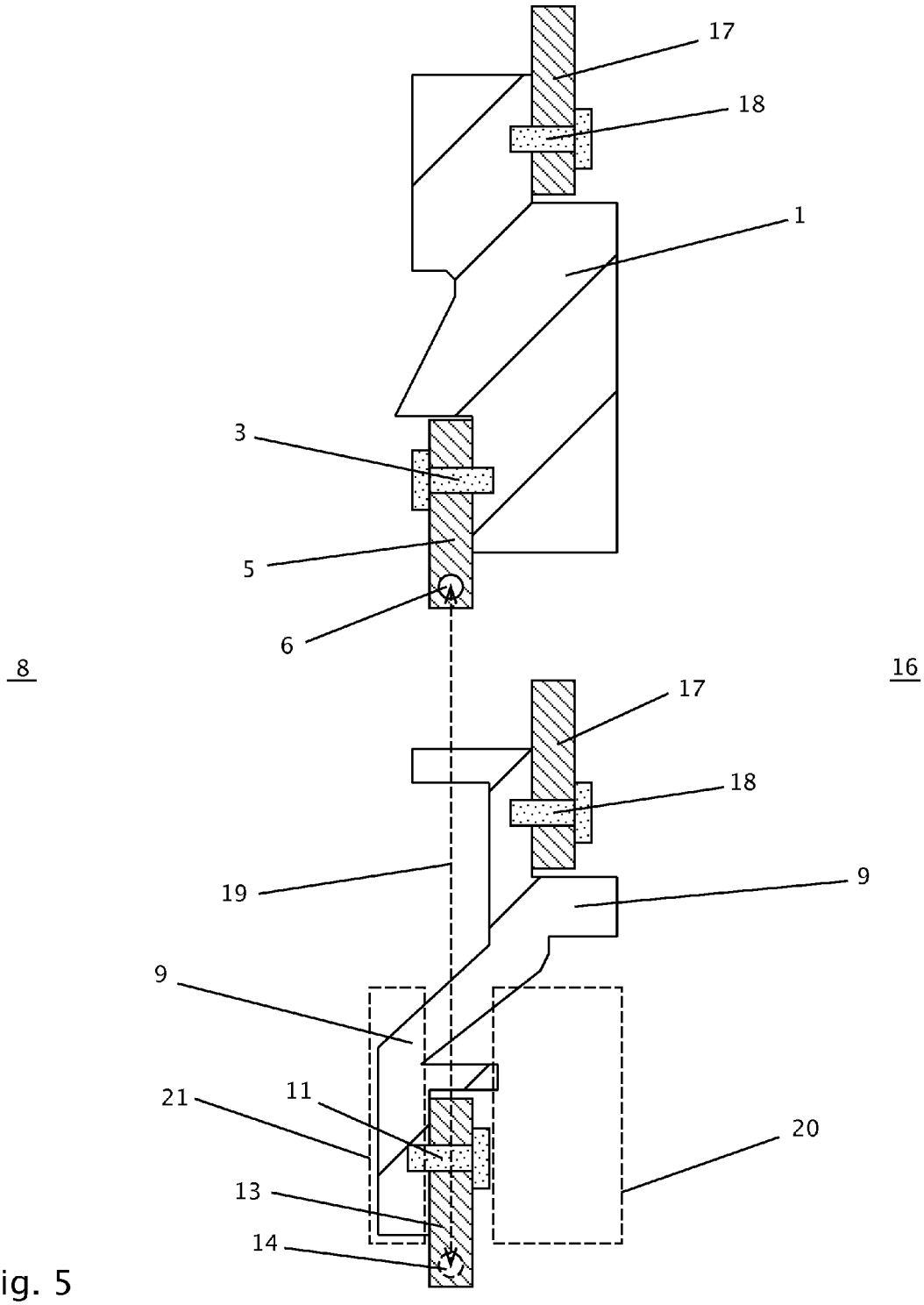
FIG. 5 is a cross sectional view of a prior art main action rail and a cross sectional view of a main action with front-accessible whippen flange screws with the two cross sectional views in vertical alignment with each other depicting how the whippen center pin or hinge pin and the whippen flange remain in the exact same location for each design, while, on the other hand, the whippen flange screws are reversed by 180 degrees with the new design.

To accomplish this, main action rail 9 must have a special cross-sectional profile that is best described by FIG. 5. The top of FIG. 5 depicts a perpendicular lateral cross section of prior art main action rail 1 at a point that is the longitudinal bisection of a whippen flange 5. Commensurately, the bottom of FIG. 5 depicts a perpendicular lateral cross section of new main action rail 9 at a point that is the longitudinal bisection of a whippen flange 13. The purpose of the top/bottom comparison of the two designs is to more visually describe the differences in cross sectional shapes of the two main action rails 1, 9. Line 19 is a vertical line depicting how whippen flange 5, along with its center pin or hinge pin 6, as attached to the prior art main action rail 1, remains in the exact same location relative to all other components of the piano action as whippen flange 13, along with its center pin or hinge pin 14, as attached to the new main action rail 9, with the new main action rail installed as a new improved replacement main action rail for the upright piano. This aspect is required for proper piano functioning of the new main action rail 9 in the piano.

The right side of FIG. 5 is the front of the piano as designated by item 16. The left side of FIG. 5 is the back or rear of the piano as designated by item 8. With this in mind, examining the top/bottom comparison of the two designs in FIG. 5, it is depicted how the new design uses a "front" attachment whippen flange screw 11, while the old design uses "rear" attachment whippen flange screw 3.

A main reason why the new design may incorporate "front" attachment whippen flange screws 11 is because of a void or clearance space 20. With the new design, just below the hammer butt flange 17, main action rail 9 does not extend straight downward with a relatively large mass of material positioned in front of whippen flange 5, as does main action rail 1, but rather angles or curves towards the rear of the piano, to then drop downward with a relatively thin mass of material 21 behind whippen flange 13. Mass of material 21 has thickness that is about half that of prior art main action rail 1. Whippen flange 13 remains in the exact same position as whippen flange 5 as between new and old designs. Clearance space 20 is required to allow a piano technician access to front attachment whippen flange screws 11.

This new cross sectional shape of main action rail 9 also provides a mass of material or solid portion 21 that does not exist with main action rail 1. Mass of material 21 of main action rail 9 extends behind whippen flange 13. Portion 21 is required to provide anchor points for the front attachment of whippen flanges 13 by whippen flange screws 11 because this portion must contain a row of tapped holes where each is used to secure a whippen flange screw 11 to yield front access capability for a piano technician.

What is claimed is:

1. A main action rail for an upright piano, wherein said main action rail is a stationary rail running horizontally across the width of said upright piano, said main action rail comprising an upper half with a front and rear surface and a lower half with a front and rear surface, said upright piano comprising a front side, a rear side, a plurality of hammer butt flanges, each attached to said upper half of said main action rail to yield a horizontal row of hammer butt flanges running parallel to said main action rail, and a plurality of whippen flanges, each attached to said lower half of said main action rail to yield a horizontal row of whippen flanges running parallel to said main action rail, each of said whippen flanges comprising a front surface and a rear surface and said horizontal row of whippen flanges comprising a front side and rear side, and said main action rail has a special cross-sectional shape so that the rear surface of said upper half of said main action rail is located on said front side of said horizontal row of whippen flanges and said front surface of said lower half of said main action rail is located on said rear side of said horizontal row of whippen flanges, thereby offsetting said lower half of said main action rail to said rear side of said horizontal row of whippen flanges, to provide a mass of material on said rear side of said horizontal row of whippen flanges and a void or clearance space on said front side of said horizontal row of whippen flanges below said horizontal row of hammer butt flanges.

* * * * *